US011676527B2

(12) United States Patent
Higuchi

(10) Patent No.: US 11,676,527 B2
(45) Date of Patent: Jun. 13, 2023

(54) DISPLAY DRIVER ADJUSTING OUTPUT TIMINGS OF DRIVING VOLTAGES AT OUTPUT CHANNELS

(71) Applicant: LAPIS Semiconductor Co., Ltd., Yokohama (JP)

(72) Inventor: Koji Higuchi, Yokohama (JP)

(73) Assignee: LAPIS Semiconductor Co., Ltd., Yokohama (JP)

( * ) Notice: Subject to any disclaimer, the term of this patent is extended or adjusted under 35 U.S.C. 154(b) by 0 days.

(21) Appl. No.: 17/403,898

(22) Filed: Aug. 17, 2021

(65) Prior Publication Data

US 2022/0068188 A1 Mar. 3, 2022

(30) Foreign Application Priority Data

Aug. 31, 2020 (JP) ..... JP2020-145605

(51) Int. Cl.

| | |
|---|---|
| ***G09G 3/36*** | (2006.01) |
| ***G09G 3/20*** | (2006.01) |
| *G09G 3/3225* | (2016.01) |

(52) U.S. Cl.

CPC ..... *G09G 3/2092* (2013.01); *G09G 3/20* (2013.01); *G09G 3/3225* (2013.01);
(Continued)

(58) Field of Classification Search

CPC ..... G09G 3/20; G09G 3/2092; G09G 3/3225; G09G 3/3648; G09G 2300/0814;
(Continued)

(56) References Cited

U.S. PATENT DOCUMENTS

2003/0098833 A1* 5/2003 Sekido ..... G09G 3/3688 345/87
2004/0233227 A1* 11/2004 Toriumi ..... G09G 3/3648 345/690

(Continued)

FOREIGN PATENT DOCUMENTS

JP 2015143780 8/2015

*Primary Examiner* — Adam J Snyder
(74) *Attorney, Agent, or Firm* — JCIPRNET

(57) ABSTRACT

A display driver is provided. A designation of an output timing at each of first and $k^{th}$ output channels is received, and first and second delay pulse signals are generated at respective output timings of the first and the $k^{th}$ output channels. First to $k^{th}$ first direction delay shift signals where a first delay pulse signal is present after a delay increased for each output channel from the first toward the $k^{th}$ output channel are generated. First to $k^{th}$ second direction delay shift signals where a second delay pulse signal is present after the delay increased for each output channel from the $k^{th}$ toward the first output channel are generated. One whose timing at which a delay pulse signal is present is earlier is selected from each of the direction delay shift signals corresponding to the same output channel, and set as first to $k^{th}$ output timing signals.

13 Claims, 12 Drawing Sheets

(52) U.S. Cl.
CPC ... *G09G 3/3648* (2013.01); *G09G 2300/0814* (2013.01); *G09G 2300/0857* (2013.01); *G09G 2310/027* (2013.01); *G09G 2310/0286* (2013.01); *G09G 2310/08* (2013.01); *G09G 2320/0223* (2013.01)

(58) Field of Classification Search
CPC ..... G09G 2300/0857; G09G 2310/027; G09G 2310/0286; G09G 2310/08; G09G 2320/0223
See application file for complete search history.

(56) References Cited

U.S. PATENT DOCUMENTS

2004/0239659 A1* 12/2004 Toriumi ..... G09G 3/3688 345/204
2007/0152947 A1* 7/2007 Tanaka ..... G09G 3/3688 345/100
2008/0068360 A1* 3/2008 Fukuo ..... G09G 3/3688 345/204
2008/0129675 A1* 6/2008 Tanaka ..... G09G 3/3688 345/99
2010/0123704 A1* 5/2010 Nishimizu ..... G09G 3/3688 345/211
2010/0123705 A1* 5/2010 Nishimizu ..... G09G 3/3688 345/211
2015/0221274 A1* 8/2015 Ishii ..... G09G 3/3677 345/100
2015/0221276 A1* 8/2015 Ishii ..... G09G 3/3685 345/98
2016/0063957 A1* 3/2016 Shirasaki ..... G09G 3/20 345/213
2017/0011703 A1* 1/2017 Higuchi ..... G09G 3/3674

* cited by examiner

DISPLAY DRIVER ADJUSTING OUTPUT TIMINGS OF DRIVING VOLTAGES AT OUTPUT CHANNELS

CROSS-REFERENCE TO RELATED APPLICATION

This application claims priority under 35 USC 119 from Japanese Patent Application No. 2020-145605, filed on Aug. 31, 2020, the disclosure of which is incorporated by reference herein.

BACKGROUND

Technical Field

The disclosure relates to a display driver driving a display panel in accordance with a video signal.

Description of Related Art

In a display panel displaying an image, such as a liquid crystal display panel, multiple gate lines extending in a horizontal direction of a two-dimensional image and multiple source lines extending in a vertical direction of the two-dimensional image are disposed to intersect each other. In addition, in the liquid crystal display panel, a source driver applying a gradation display voltage in accordance with a luminance level of each pixel represented by an input video signal to each source line and a gate driver applying a gate signal selecting a display line as a driving target to a gate line.

As such a source driver, a source driver (see Patent Document 1, Japanese Patent Application Laid-Open (JP-A) No. 2015-143780, for example) individually capturing multiple display data corresponding to one horizontal synchronization period to N (N being an integer of 2 or more) latches and applying a driving voltage having a voltage value corresponding to the display captured to each latch to each source line has been proposed.

In such source driver, flip flops (referred to as "FF") of N stages (N being an integer of 2 or more) synchronized with a reference timing signal to shift and capture a single-pulse delay pulse signal to the next stage in order are provided, the outputs of the respective FFs, as captured signals, are respectively supplied to the N latches individually. Accordingly, since the timings at which the respective driving voltages are respectively applied to the source lines are different, the situation in which drastic changes of currents flowing to the source line group occur at the same time is avoided, and the noise occurring in such state is suppressed.

In recent years, in large-sized, high-definition display panels, multiple source driver ICs built by splitting the source driver into multiple IC chips are provided on an end side of the source line group.

When such display panel is to be driven, since the gate lines and the source lines are long, the waveforms of gate signals and driving voltages become dull due to the wiring resistance for such a long line length. The dullness degree of the waveform differs as the position in the image of the display panel differs. For example, compared with the positions on the ends of the image, the line length from each driver to the position at the image center of the display panel is longer. Therefore, the waveforms of the gate signals and the driving voltages become dull. That is, the delay time increases. Accordingly, the timing at which the driving voltage is output suitable for a gate signal at the position of the end of the image is different from the position at the center of the image of the display panel.

Therefore, it is considered to apply the technology of Patent Document 1 to perform driving incorporating the arrival timings of gate signals by delaying the timing of applying the driving voltage to each source line stage-by-stage by a predetermined unit delay amount toward the image center of the display panel.

However, in the case where the display panel is driven by multiple source drivers, when the deviation amount of the output timing of the driving voltage between the adjacent output channels of the source drivers adjacent to each other increases, display unevenness may occur in the boundary part.

Accordingly, in order to suppress such display unevenness, it is considered to perform adjustment to reduce the display time difference in driving voltage output timing between the output channels of the respective source drivers.

However, when such adjustment is to be performed, it becomes necessary to increase the circuit frequency, which reduces the unit delay amount determining the output timing of the driving voltage, and the issue that the circuit scale is increased arises.

In addition, by changing the unit delay amount, the output timing of the driving voltage at the last output channel is also changed. Thus, it is also necessary to change the output timing of the initial output channel of the source driver adjacent to the source driver, so as to reduce the delay time difference with respect to the output timing of the driving voltage in the last output channel of the source driver. Thus, there is also an issue that the adjustment is complicated.

SUMMARY

A display driver according to an embodiment of the disclosure has first to $k^{th}$ output channels outputting first to $k^{th}$ pixel driving voltages respectively corresponding luminance levels of respective pixels indicated in a video signal, k being an integer of 2 or more. The display driver includes: an output timing control part, generating first to $k^{th}$ output timing signals indicating output timings at the respective first to $k^{th}$ output channels; and an output part, respectively outputting the first to $k^{th}$ pixel driving voltages at the output timings indicated in the respective first to $k^{th}$ output timing signals. The output timing control part includes: a control signal generation part, receiving a designation of the output timing at each of the first to $k^{th}$ output channels and generating a first delay pulse signal at the output timing of the first output channel that is designated and generating a second delay pulse signal at the output timing of the $k^{th}$ output channel that is designated; a first delay generation part, receiving the first delay pulse signal, and generating first to $k^{th}$ first direction delay shift signals in which the first delay pulse signal is present after a delay increased by a unit delay time for each output channel from the first output channel to the $k^{th}$ output channel, a second delay generation part, receiving the second delay pulse signal, and generating first to $k^{th}$ second direction delay shift signals in which the second delay pulse signal is present after the delay increased by the unit delay time for each output channel from the $k^{th}$ output channel to the first output channel, and a delay selection part, for each of the first to $k^{th}$ output channels, selecting one whose timing at which the delay pulse signal is present is earlier from each of the first to $k^{th}$ first direction delay shift signals and each of the first to $k^{th}$ second direction delay shift signals that are those corresponding to the same output channel, and outputting the selected signals for the respective first to $k^{th}$ output channels as the first to $k^{th}$ output timing signals.

DESCRIPTION OF THE EMBODIMENTS

The disclosure provides a display driver which makes it easy to adjust the output timing suppressing display unevenness without increasing the circuit scale when a display panel is driven by multiple display drivers.

In the disclosure, in adjusting the output timing of each of the first to $k^{th}$ (k being an integer of 2 or more) of the display driver, firstly, the designations of the output timings at the first to $k^{th}$ output channels are received. Then, the first delay pulse signal is generated at the output timing of the first output channel that is designated, and the second delay pulse signal is generated at the output timing of the $k^{th}$ output channel that is designated. Here, the first to $k^{th}$ first direction delay shift signals in which the first delay pulse signal is present after a delay increased for each output channel from the first toward the $k^{th}$ output channel are generated. In addition, the first to $k^{th}$ second direction delay shift signals in which the second delay pulse signal is present after the delay increased for each output channel from the $k^{th}$ toward the first output channel are generated. Then, one whose timing at which the delay pulse signal is present is earlier is selected from each of the first to $k^{th}$ first direction delay shift signals and each of the first to $k^{th}$ second direction delay shift signals that are those corresponding to the same output channel. Then, the signals selected for the respective first to $k^{th}$ output channels are set as the first to $k^{th}$ output timing signals. At the output timings in accordance with the first to $k^{th}$ output timing signals, the first to $k^{th}$ pixel driving voltages corresponding to the respective pixels are output.

Accordingly, when a display panel is driven by multiple display drivers, by designating the output timing of each of the first and second output channels for each display driver, an adjustment which reduces the output timing delay time at the boundary between adjacent display drivers can be made without reducing the unit delay time.

Therefore, according to the disclosure, the display driver makes it easy to adjust the output timing suppressing display unevenness without increasing the circuit scale when the display panel is driven by multiple display drivers.

In the following, the embodiments of the disclosure will be described with reference to the drawings.

Figure 1:
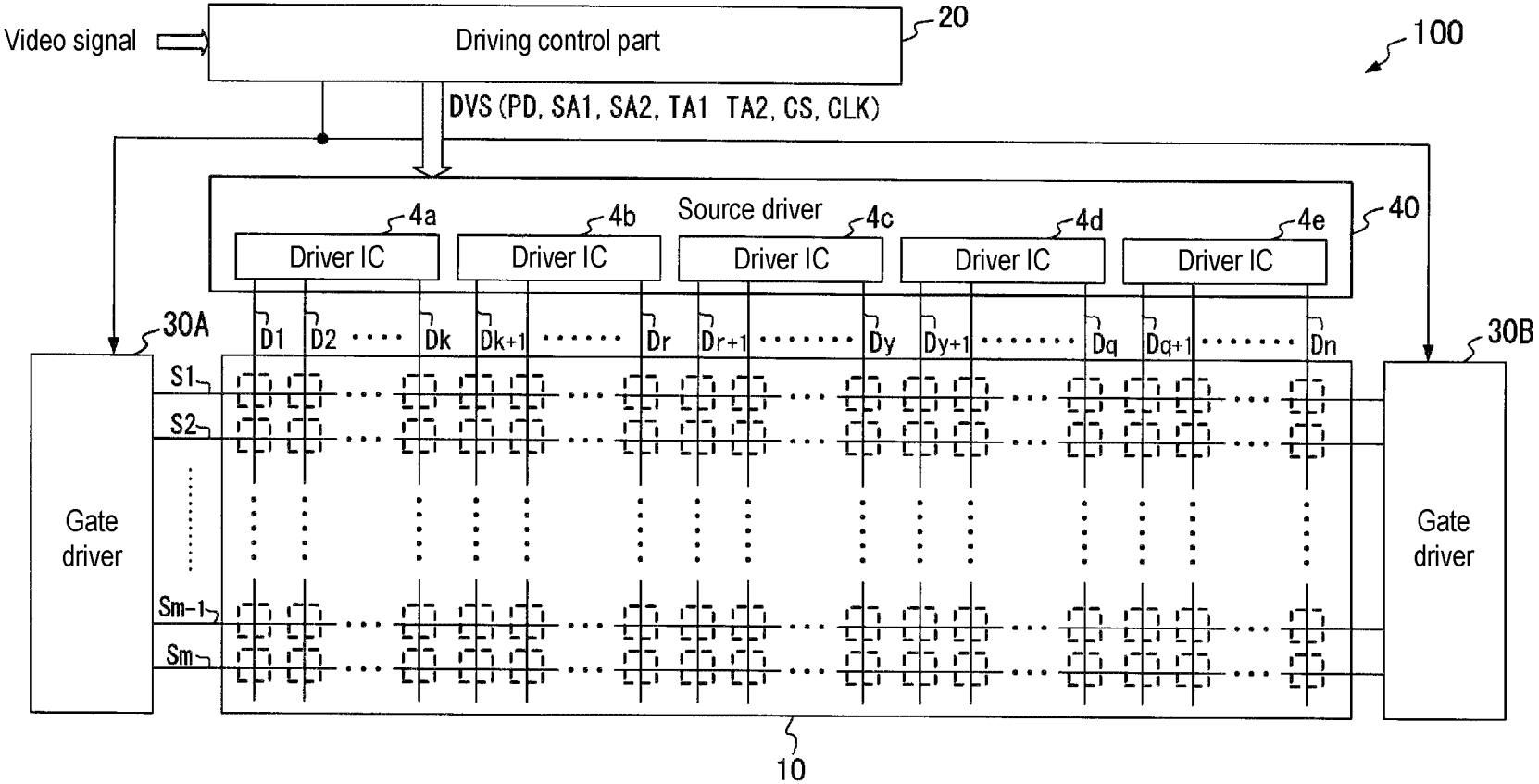
FIG. 1 is a block diagram illustrating a schematic configuration of a display device 10 including a display driver according to the disclosure.

FIG. 1 is a diagram illustrating a schematic configuration of a display device 10 including a display driver according to the disclosure. As shown in FIG. 1, such display device 100 includes a drive control part 20, gate drivers 30A and 30B, a source driver 40, and a display panel 10. The source driver 40 is configured from multiple semiconductor integrated circuit (IC) chips respectively having the same configuration. For example, in the embodiment shown in FIG. 1, the source driver 40 is configured from five driver ICs 4*a* to 4*e* each having k output channels (k being an integer of 2 or more) obtained by dividing n output channels (n being a natural number of 2 or more) of the source driver 40 into five.

The display panel 10 is, for example, formed by a liquid crystal panel or an organic electroluminescent panel, etc. The display panel 10 includes m horizontal scan lines S1 to Sm (m being an integer of 2 or more) respectively extending in the horizontal direction of a two-dimensional image and n data lines D1 to Dn respectively extending in the vertical direction of the two-dimensional image. In each intersection of the gate lines and the source lines, a display cell for a pixel is formed.

The drive control part 20 receives a video signal as a display target, extracts a horizontal synchronization signal and a vertical synchronization signal from the video signal, and supplies the horizontal synchronization signal to the gate drivers 30A and 30B.

In addition, the drive control part 20 generates a series of pixel data PD representing the luminance level for each pixel in 8 bits, for example, based on such video signal.

In addition, the drive control part 20 supplies, together with the series of pixel data PD and a reference clock signal CLK, a video data signal DVS including delay shift amount setting data SA1 and SA2, start timing setting data TA1 and TA2, and a synchronization signal CS to the source driver 40.

The synchronization signal CS includes the horizontal synchronization signal, for example.

The shift amount setting data SA1 is data which designates, for each of the driver ICs 4*a* to 4*e*, a unit delay time at the time when a delay applied to the output timing is increased stage by stage from the first output channel to the $k^{th}$ output channel (also referred to as "rightward").

The shift amount setting data SA2 is data which designates, for each of the driver ICs 4*a* to 4*e*, a unit delay time at the time when a delay applied to the output timing is increased stage by stage from the $k^{th}$ output channel to the first output channel (also referred to as "leftward").

The start timing setting data TA1 is data which designates the output timing at the first output channel for each of the driver ICs 4*a* to 4*e*.

The start timing setting data TA2 is data which designates the output timing at the $k^{th}$ output channel for each of the driver ICs 4*a* to 4*e*.

The gate driver 30A is connected to an end of each of the gate lines S1 to Sm, and the gate driver 30B is connected to the other end of each of the gate lines S1 to Sm. The gate drivers 30A and 30B are synchronized with the horizontal synchronization signal to generate gate pulses, and apply the gate pulses to each of the gate lines S1 to Sm of the display panel 10 in order.

The source driver 40 generates n pixel driving voltages G1 to Gn respectively corresponding to the source lines D1 to Dn of the display panel 10 based on the video data signal DVS and output the n pixel driving voltages G1 to Gn to the source lines D1 to Dn.

Here, the driver IC 4*a* forming the source driver 40 generates the pixel driving voltages G1 to Gk respectively corresponding to the k source lines D1 to Dk among the source lines D1 to Dn of the display panel 10 and outputs the pixel driving voltages G1 to Gk to the source lines D1 to Dk, respectively. The driver IC 4*b* generates the pixel driving voltages Gk+1 to Gr respectively corresponding to the k source lines Dk+1 to Dr (r being 2*k) among the source lines D1 to Dn and outputs the pixel driving voltages Gk+1 to Gr to the source lines Dk+1 to Dr, respectively. The driver IC 4*c* generates the pixel driving voltages Gr+1 to Gy respectively corresponding to the k source lines Dr+1 to Dy (y being 3*k) among the source lines D1 to Dn and outputs the pixel driving voltages Gr+1 to Gy to the source lines Dk+1 to Dr, respectively. The driver IC 4*d* generates the pixel driving voltages Gy+1 to Gq respectively corresponding to the k source lines Dy+1 to Dq (q being 4*k) among the source lines D1 to Dn and outputs the pixel driving voltages Gy+1 to Gq to the source lines Dy+1 to Dq, respectively. The driver IC 4*e* generates the pixel driving voltages Gq+1 to Gn respectively corresponding to the k source lines Dq+1 to Dn among the source lines D1 to Dn and outputs the pixel driving voltages Gq+1 to Gn to the source lines Dq+1 to Dn, respectively.

Figure 2:
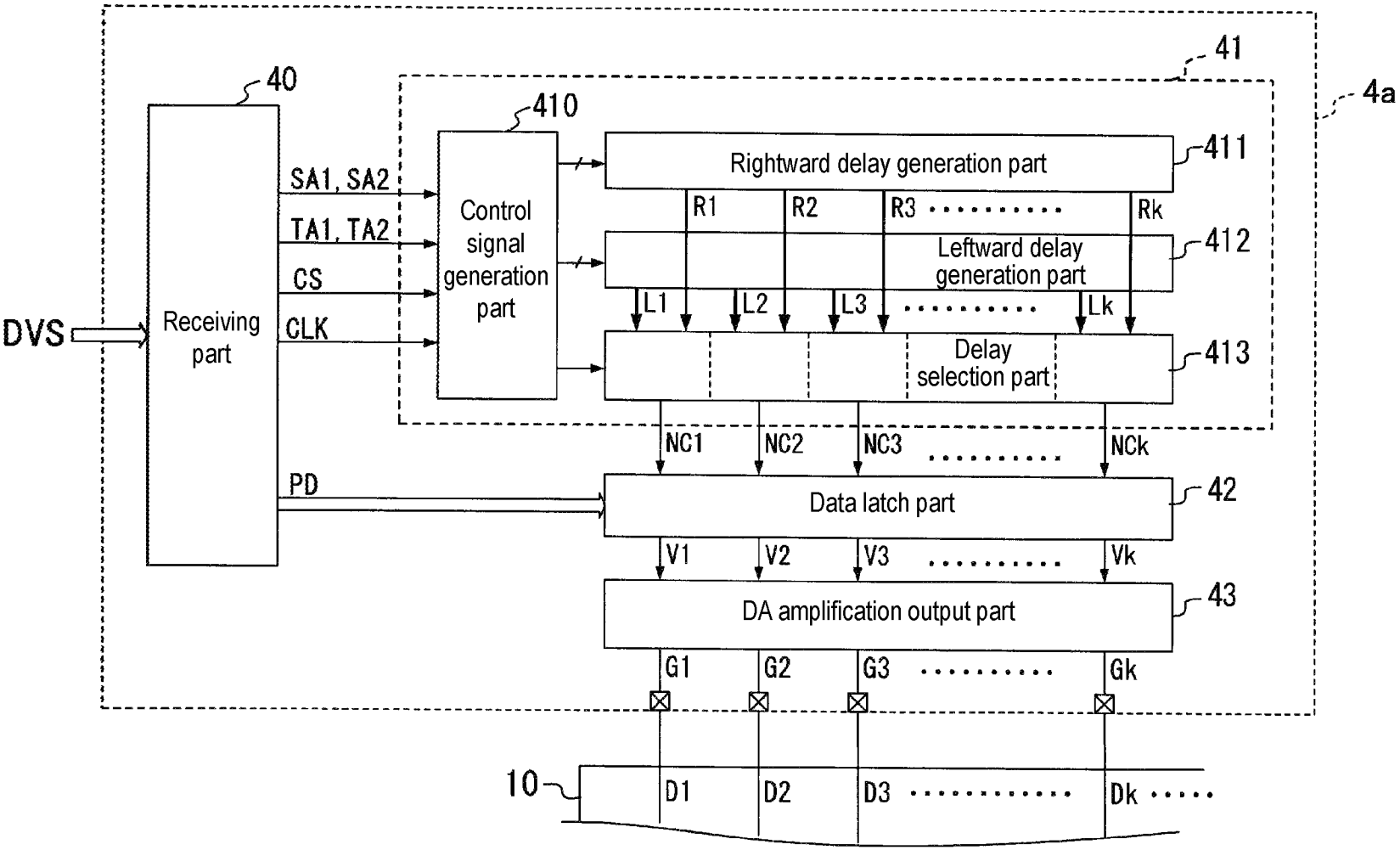
FIG. 2 is a block diagram illustrating an example of the internal configuration of a driver IC 4*a*.

FIG. 2 is a block diagram illustrating the internal configuration of a source driver by taking the driver IC 4*a* among the driver ICs 4*a* to 4*e*.

As shown in FIG. 2, the driver IC 4*a* includes a receiving part 40, an output timing control part 41, a data latch part 42, and a DA amplification output part 43.

The receiving part 40 receives the video data signal DVS, and extracts, from the video data signal DVS, the series of pixel data PD, the delay shift amount setting data SA1 and SA2, the start timing setting data TA1 and TA2, and the synchronization signal CS. The receiving part 40 supplies the extracted delay shift amount setting data SA1 and SA2, start timing setting data TA1 and TA2, and synchronization signal CS to the output timing control part 41, and supplies the extracted series of pixel data PD to the data latch part 42.

The output timing control part 41 receives the synchronization signal CS and the reference clock signal CLK as well as output delay control data including the delay shift amount setting data SA1 and SA2 and the start timing setting data TA1 and TA2.

The output timing control part 41 generates output timing signals NC1 to NCk indicating the output timings of the respective first to $k^{th}$ output channels based on the synchronization signal CS, the reference clock signal CLK, and the output delay control data (SA1, SA2, TA1, and TA2). That is, the output timing control part 41 generates the output timing signals NC1 to NCk in which the delay times are changed for the respective output channels in delaying the output timings at the respective output channels. The output timing control part 41 supplies the generated output timing signals NC1 to NCk to the data latch part 42.

The data latch part 42 latches k consecutive pixel data PD in the series of pixel data PD supplied from the receiving part 40 and outputs, respectively as pixel data V1 to Vk, the k consecutive pixel data PD to the DA amplification output part 43 at the respective output timings indicated in the output timing signals NC1 to NCk.

The DA amplification output part 43 converts the pixel data V1 to Vk into k gradation voltages having analog voltage values respectively representing luminance levels, and outputs the k gradation voltages, which are individually amplified, as pixel driving voltages G1 to Gk.

Accordingly, the driver IC 4*a* outputs the pixel driving voltages G1 to Gk at the output timings with the delay time changed for each output channel based on the delay control data (SA1, SA2, TA1, and TA2). The pixel driving voltages G1 to Gk output from the driver IC 4*a* are applied to the source lines D1 to Dk of the display panel 10.

Also, as shown in FIG. 2, the output timing control part 41 includes a control signal generation part 410, a rightward delay generation part 411, a leftward delay generation part 412, and a delay selection part 413.

The control signal generation part 410 generates various control signals controlling the rightward delay generation part 411 and the leftward delay generation part 412 at the timing synchronized with the reference clock signal CLK and the synchronization signal CS based on the output delay control data (SA1, SA2, TA1, and TA2). In addition, the control signal generation part 410 generates a control signal controlling the delay selection part 413 at the timing synchronized with the synchronization signal CS.

The rightward delay generation part 411 generates rightward delay shift signals R1 to Rk in which a single delay pulse signal is present with a delay of a unit delay time for each output channel from the first output channel to the $k^{th}$ output channel.

Specifically, the rightward delay generation part 411 generates a rightward delay shift signal R1 in which a delay pulse signal is present at an output timing designated in the start timing setting data TA1 and which sets the synchronization signal CS (horizontal synchronization signal) as the reference point. In addition, the rightward delay generation part 411 generates rightward delay shift signals R2 to Rk in which a delay pulse signal is present with a delay of a unit delay time designated in the delay shift amount setting data SA1 for each output channel from the first output channel to the $k^{th}$ output channel.

The rightward delay generation part 411 supplies the rightward delay shift signals R1 to Rk generated according to the above to the delay selection part 413.

The leftward delay generation part 412 generates leftward delay shift signals L1 to Lk in which a single delay pulse signal is present with a delay of a unit delay time for each output channel from the $k^{th}$ output channel to the first output channel based on the various control signals supplied from the control signal generation part 410.

Specifically, the leftward delay generation part 412 generates a leftward delay shift signal Lk in which a delay pulse signal is present at an output timing designated in the start timing setting data TA2 and which sets the synchronization signal CS (horizontal synchronization signal) as the reference point. In addition, the leftward delay generation part 412 generates leftward delay shift signals Lk−1 to L1 in which a delay pulse signal is present with a delay of a unit delay time designated in the delay shift amount setting data SA2 for each output channel from the $k^{th}$ output channel to the first output channel.

The leftward delay generation part 412 supplies the leftward delay shift signals L1 to Lk generated according to the above to the delay selection part 413.

The delay selection part 413 selects one with the earlier timing at which the delay pulse signal is present from the rightward delay shift signal (R1 to Rk) and the leftward delay shift signal (L1 to Lk) that are signals corresponding to the same output channel for each output channel. In addition, for the respective first to $k^{th}$ output channels, the delay selection part 413 supplies the signals selected as the above to the data latch part 42 as the output timing signals NC1 to NCk.

For example, in the case where the timing at which the delay pulse signal is present in the rightward delay shift signal R1 is earlier between the rightward delay shift signal R1 and the leftward delay shift signal L1 corresponding to the first output channel, the delay selection part 413 selects the rightward delay shift signal R1. At this time, the delay selection part 413 supplies the selected rightward delay shift signal R1, as the output timing signal NC1, to the data latch part 42. In addition, in the case where the timing at which the delay pulse signal is present in the leftward delay shift signal L2 is earlier between the rightward delay shift signal R2 and the leftward delay shift signal L2 corresponding to the second output channel, the delay selection part 413 selects the leftward delay shift signal L2. At this time, the delay selection part 413 supplies the selected leftward delay shift signal L2, as the output timing signal NC2, to the data latch part 42.

Figure 3:
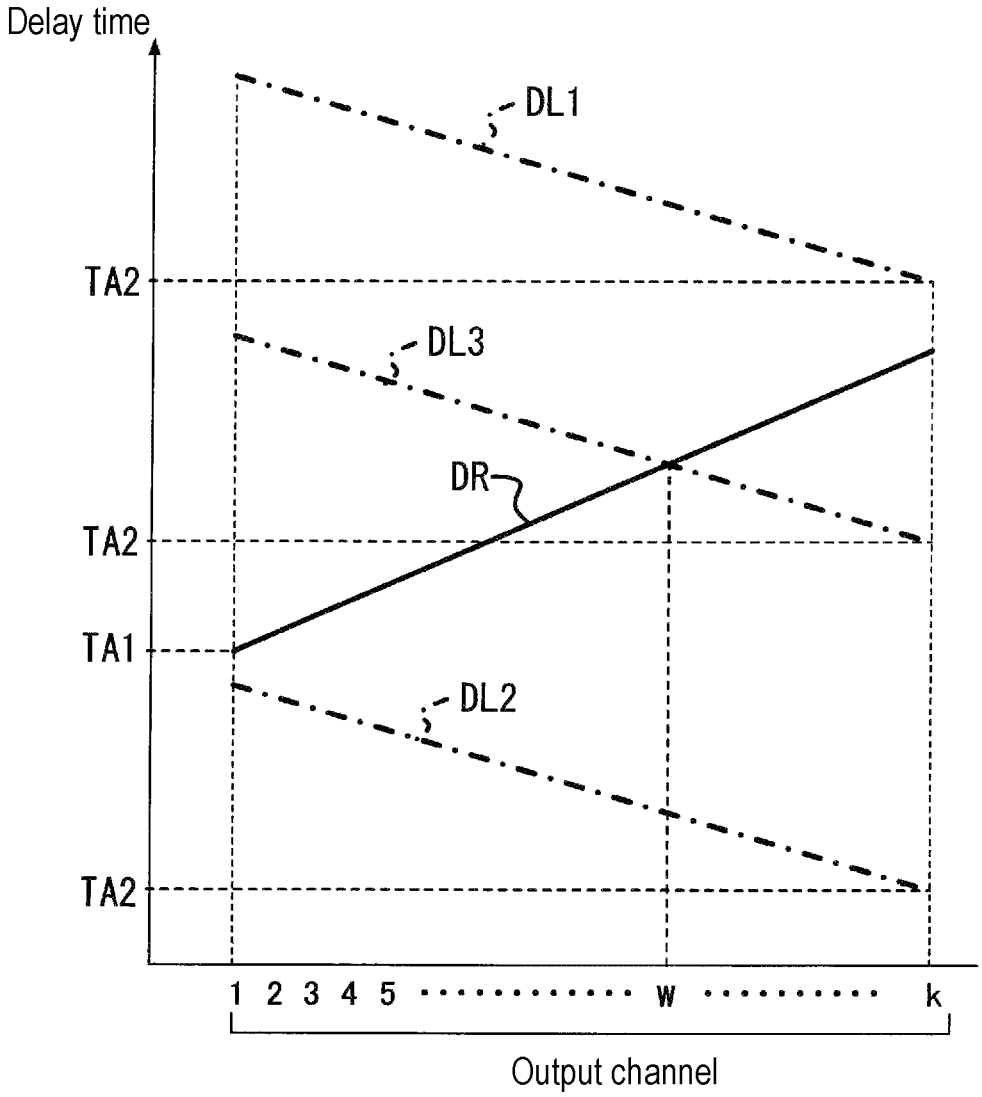
FIG. 3 is a diagram illustrating an example of a delay property DR based on rightward delay shift signals R1 to Rk and delay properties DL1 to DL3 of three systems based on leftward delay shift signals L1 to Lk.

FIG. 3 is a diagram illustrating an example of a delay property DR of a delay pulse based on the rightward delay shift signals R1 to Rk and delay properties DL1 to DL3 of three systems as delay properties of a delay pulse based on the leftward delay shift signals L1 to Lk.

The delay property DL1 is a property obtained in the case where a timing later than the output timing of the $k^{th}$ output channel in the delay property DR is designated in the start timing setting data TA2. At this time, for a rightward delay shift signal R(t) (t being an integer of 1 to k) corresponding to the delay property DR, the timing at which the delay pulse signal is present is earlier than a leftward delay shift signal L(t) corresponding to the delay property DL1.

Figure 4A:
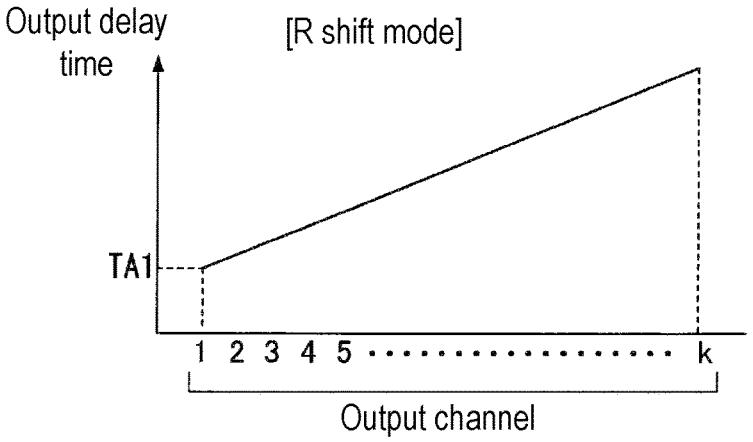
FIG. 4A is a diagram illustrating an output timing delay property in an R shift mode.

Accordingly, in the case of receiving the rightward delay shift signals R1 to Rk corresponding to the delay property DR and the leftward delay shift signals L1 to Lk corresponding to the delay property DL1, the delay selection part 413 selects the rightward delay shift signals R1 to Rk and respectively output the rightward delay shift signals R1 to Rk as the output timing signals NC1 to NCk. According to the output timing signals NC1 to NCk, as shown in FIG. 4A, the pixel driving voltages G1 to Gn respectively corresponding to the first to the $k^{th}$ output channels are output along the output timing delay property (R shift mode) of increasing the delay time of the output timing from the first output channel toward the $k^{th}$ output channel.

The delay property DL2 is a property obtained in the case in which the start timing setting data TA2 is set so that the output timing corresponding to the first output channel is earlier than the output timing designated in the start timing setting data TA1. At this time, for the leftward delay shift signal L(t) (t being an integer of 1 to k) corresponding to the delay property DL2, the timing at which the delay pulse signal is present is earlier than the rightward delay shift signal R(t) corresponding to the delay property DR.

Figure 4B:
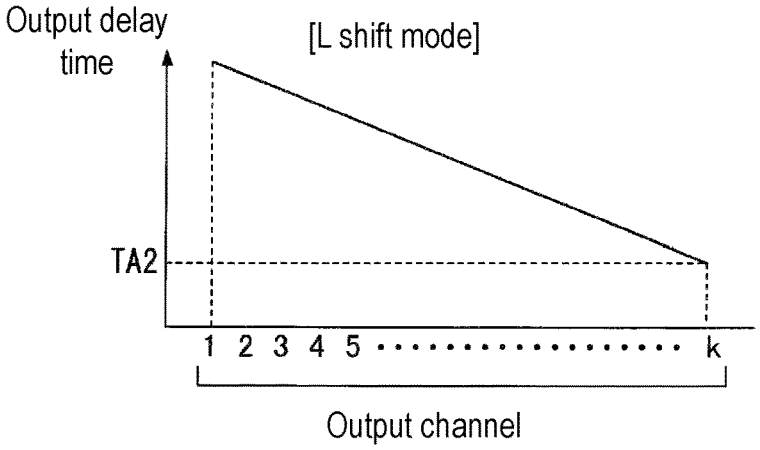
FIG. 4B is a diagram illustrating an output timing delay property in an L shift mode.

Accordingly, in the case of receiving the rightward delay shift signals R1 to Rk corresponding to the delay property DR and the leftward delay shift signals L1 to Lk corresponding to the delay property DL2, the delay selection part 413 selects the leftward delay shift signals L1 to Lk and respectively output the leftward delay shift signals L1 to Lk as the output timing signals NC1 to NCk. According to the output timing signals NC1 to NCk, as shown in FIG. 4B, the pixel driving voltages G1 to Gn respectively corresponding to the first to the $k^{th}$ output channels are output along the output timing delay property (L shift mode) of increasing the delay time of the output timing from the $k^{th}$ output channel toward the first output channel.

The delay property DL3 is a property obtained in the case in which the start timing setting data TA2 is designated, so that the leftward delay shift signal L1 is later than the rightward delay shift signal R1, and the leftward delay shift signal Lk is earlier than the rightward delay shift signal Rk.

As shown in FIG. 3, for a rightward delay shift signal R(u) (u being an integer of 1 to w) corresponding to the first to $w^{th}$ output channels (w being an integer within a range of 2 to k−1) along the delay property DR, the timing at which the delay pulse signal is present is earlier than a leftward delay shift signal L(u) at the first to $w^{th}$ output channels along the delay property DL3. In addition, for a leftward delay shift signal L(x) (x being an integer of w+1 to k) corresponding to the $w+1^{th}$ to $k^{th}$ output channels along the delay property DL3, the timing at which the delay pulse signal is present is earlier than a rightward delay shift signal R(x) at the $w+1^{th}$ to $k^{th}$ output channels along the delay property DR.

Figure 4C:
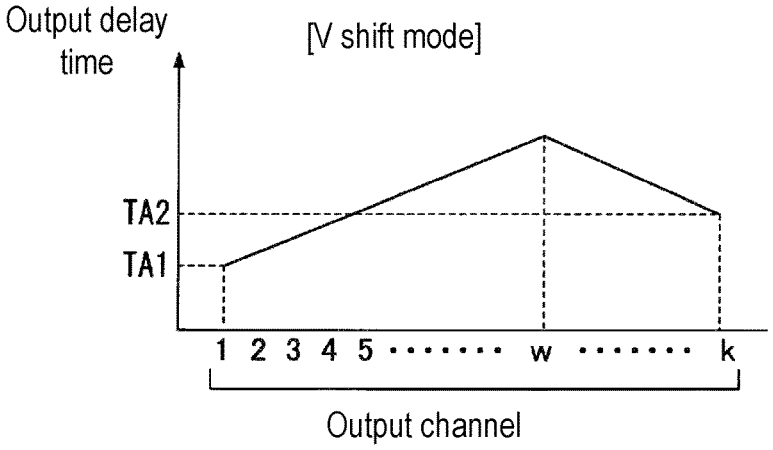
FIG. 4C is a diagram illustrating an output timing delay property in a V shift mode.

Accordingly, among the leftward delay shift signals L1 to Lk and the rightward delay shift signals R1 to Rk, the delay selection part 413 selects the rightward delay shift signals R1 to Rw and the leftward delay shift signals Lw+1 to Lk and output the rightward delay shift signals R1 to Rw and the leftward delay shift signals Lw+1 to Lk as the output timing signals NC1 to NCk. According to the output timing signals NC1 to NCk, as shown in FIG. 4C, the pixel driving voltages G1 to Gn respectively corresponding to the first to the $k^{th}$ output channels are output along the output timing delay property (V shift mode) that the change tendency of the delay time applied to the output timing is switched from increasing to decreasing with the $w^{th}$ output channel as the boundary.

In the V shift mode, by designating the start timing setting data TA2, the output timing at the $k^{th}$ output channel can be adjusted without changing the unit delay time.

Figure 5:
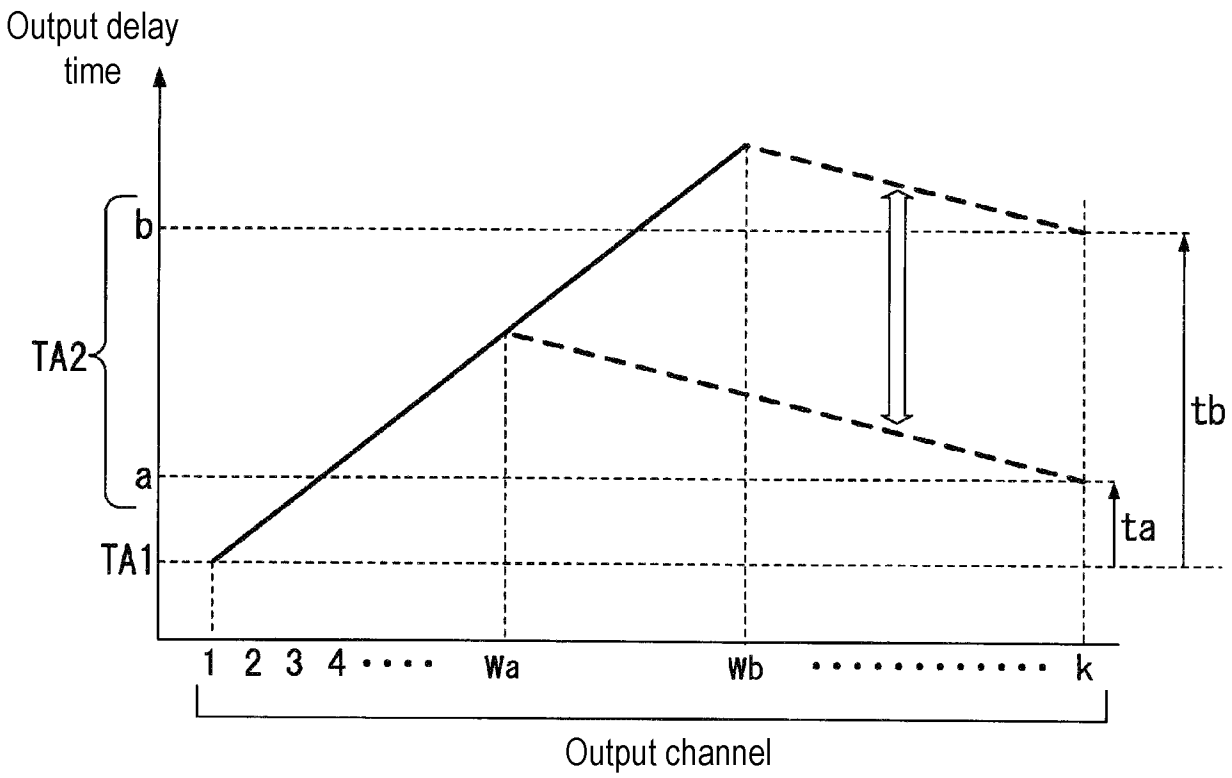
FIG. 5 is a diagram illustrating an example of an output timing delay form adjusted by designations of start timing setting data TA1 and TA2.

FIG. 5 is a diagram illustrating an example of an output timing delay form adjusted by designation of the start timing setting data TA1 and TA2.

As shown in FIG. 5, in the case where the output timing at the $k^{th}$ output channel designated in the start timing setting data TA2 is set as "a", the output timing at the $k^{th}$ output channel is delayed by a delay time ta with respect to the output timing at the first output channel. As shown in FIG. 5, in the case where the output timing at the $k^{th}$ output channel designated in the start timing setting data TA2 is set as "b" later than "a", the output timing at the $k^{th}$ output channel is delayed by a delay time tb (ta<tb) with respect to the output timing at the first output channel. At this time, as shown in FIG. 5, regarding the output channel that serves as the boundary where the delay time applied to the respective output timings from the first output channel to the $k^{th}$ output channel is switched from the increasing tendency to the decreasing tendency, the longer the delay time at the $k^{th}$ output channel, the closer the output channel that serves as the boundary is to the $k^{th}$ output channel side.

Figure 6:
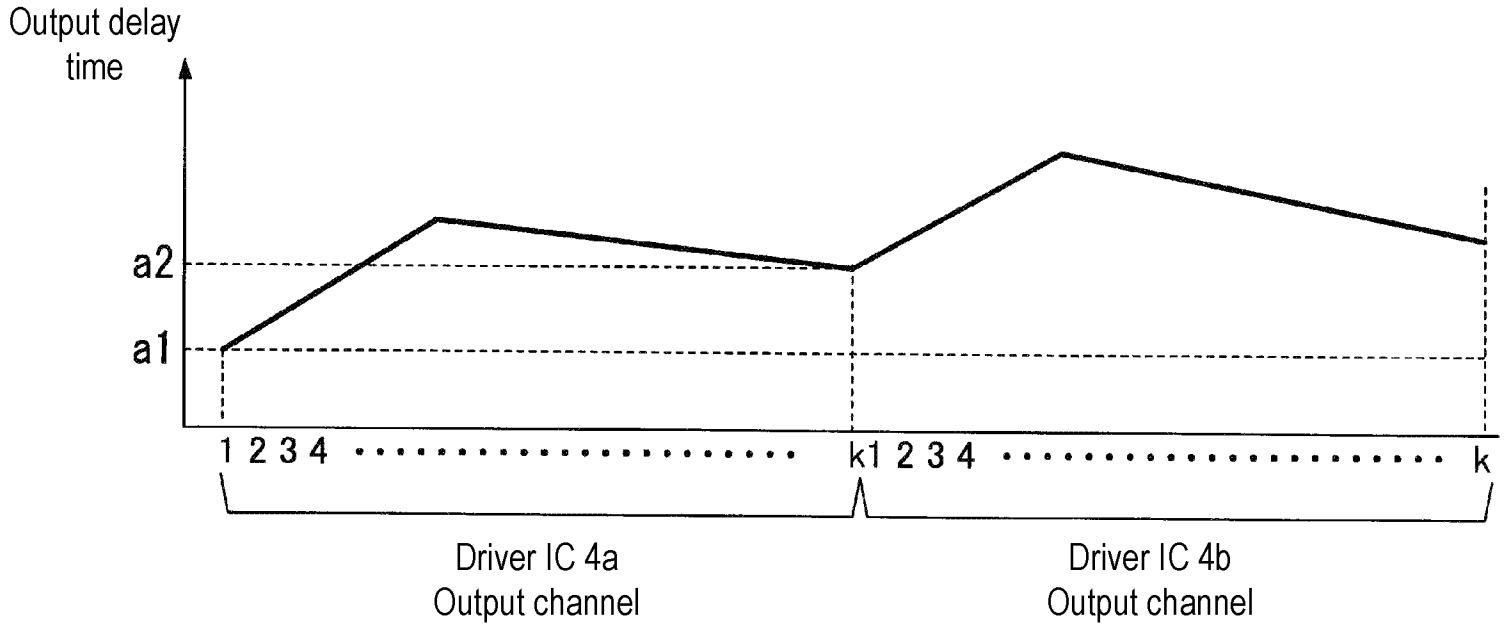
FIG. 6 is a diagram illustrating an example of output timing delay forms of an IC 4*a* and an IC 4*b*, respectively, adjusted by the start timing setting data TA1 and TA2.

FIG. 6 is a diagram illustrating an example of an output timing delay form adjusted by the start timing setting data TA1 and TA2, taking the driver ICs 4*a* and 4*b* arranged in adjacency from the driver ICs 4*a* to 4*e* shown in FIG. 1

In the example shown in FIG. 6, the driver IC 4*a* is supplied with the start timing setting data TA1 designating the output timing at the first output channel as "a1" and the start timing setting data TA2 designating the output timing at the $k^{th}$ output channel as "a2". Meanwhile, the driver IC 4*b* arranged adjacent to the driver IC 4*a* is supplied with the start timing setting data TA1 designating the output timing at the first output channel as "a2" or a value near "a2".

Thus, according to the output timing control part 41, by designating the start timing setting data TA1 and TA2, it is possible to perform adjustment reducing the delay time difference in output timing between the adjacent output channels of the driver ICs (source drivers) adjacent to each other without reducing the unit delay time.

Therefore, according to the disclosure, the circuit scale is not increased, and the output timing adjustment suppressing display unevenness is performed easily.

In the following, the specific configurations of the rightward delay generation part 411, the leftward delay generation part 412, and the delay selection part 413 included in the output timing control part 41 shown in FIG. 2 will be described.

Figure 7:
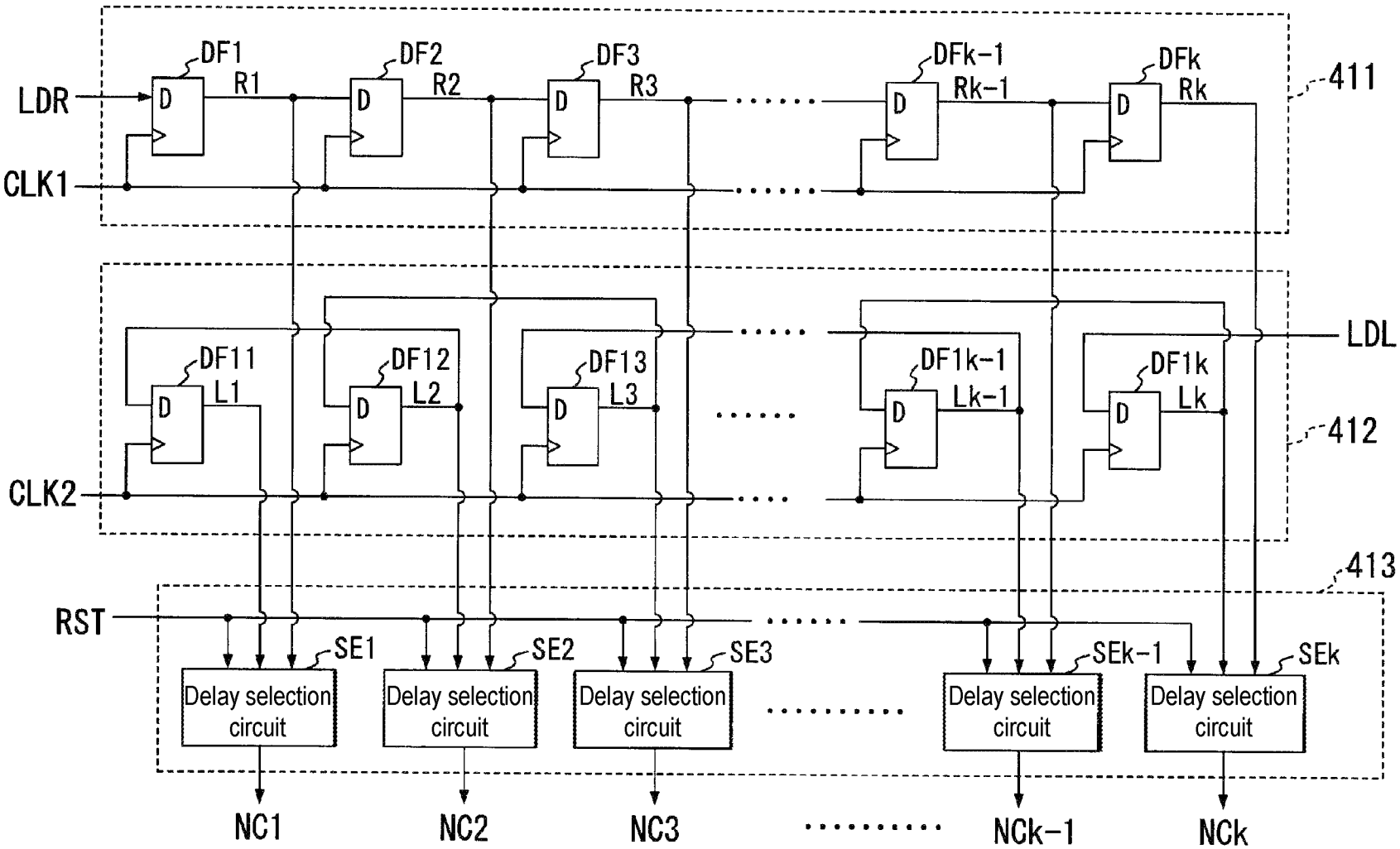
FIG. 7 is a circuit diagram of an example of the internal configurations of a rightward delay generation part 411, a leftward delay generation part 412, and a delay selection part 413.

FIG. 7 is a circuit diagram of an example of the internal configurations of the rightward delay generation part 411, the leftward delay generation part 412, and the delay selection part 413.

In the case where the configuration shown in FIG. 7 is adopted, the control signal generation part 410 generates a delay pulse signal LDR, a delay pulse signal LDL, a reset signal RST, and clock signals CLK1 and CLK2 as follows based on the output delay control data (SA1, SA2, TA1, and TA2), the reference clock signal CLK, and the synchronization signal CS.

Figure 8:
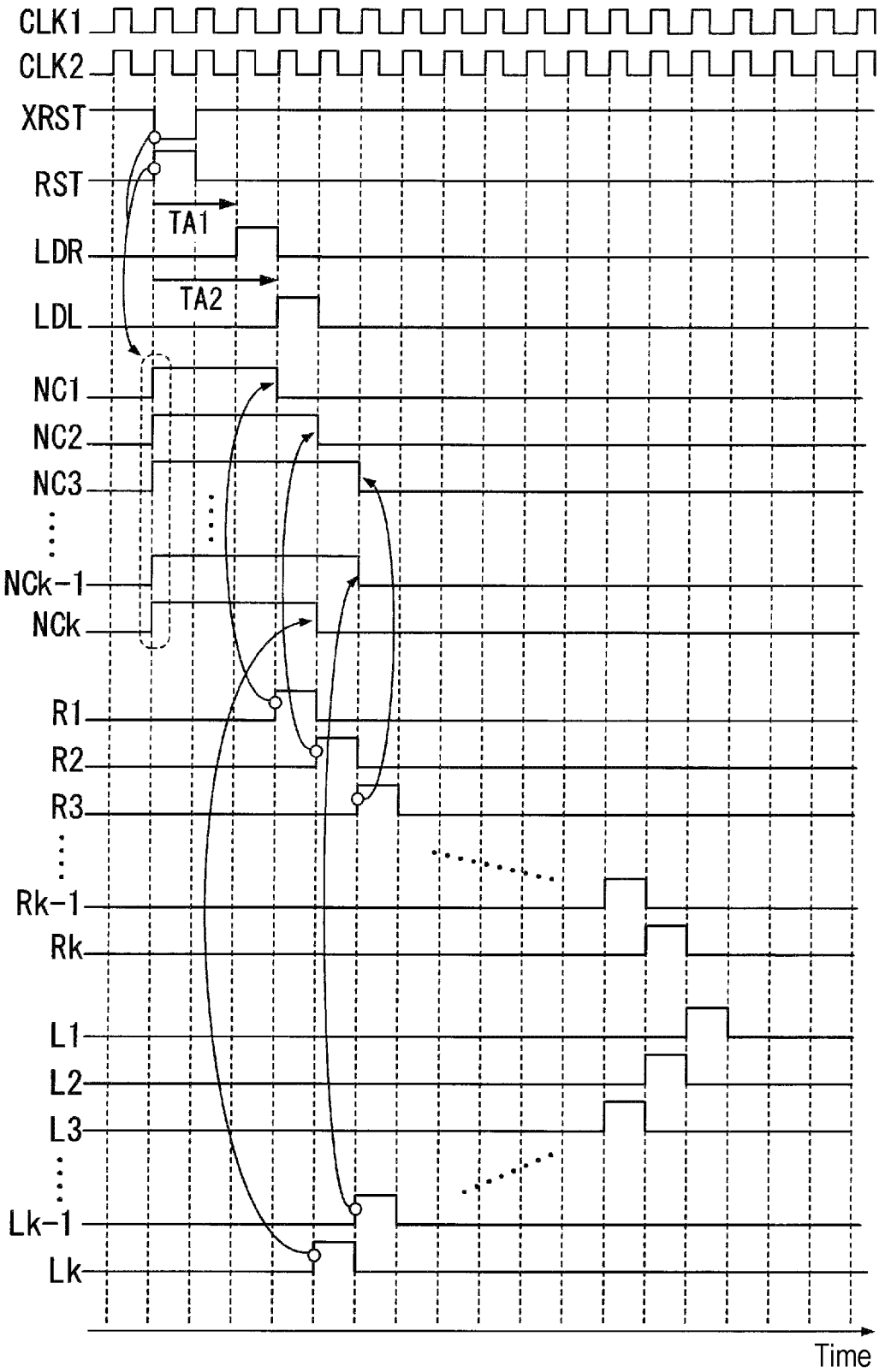
FIG. 8 is a flowchart illustrating an example of the operations of the rightward delay generation part 411, the leftward delay generation part 412, and the delay selection part 413.

That is, the control signal generation part 410 generates the clock signal CLK1 as shown in FIG. 8, setting the unit delay time designated in the delay shift amount setting data SA1 as one cycle, by using the reference clock signal CLK. In addition, the control signal generation part 410 generates the clock signal CLK2 as shown in FIG. 8, setting the unit delay time designated in the delay shift amount setting data SA2 as one cycle, by using the reference clock signal CLK.

Also, while the cycles of the clock signals CLK1 and CLK2 in the example shown in FIG. 8 are the same, in the case where the unit delay time designated in the delay shift amount setting data SA1 and SA2 are different from each other, the cycles of the clock signals CLK1 and CLK2 are also different from each other.

In addition, the control signal generation part 410 generates the reset signal RST with a single pulse as shown in FIG. 8 in accordance with the synchronization signal CS (horizontal synchronization signal).

In addition, the control signal generation part 410 generates the delay pulse signal LDR with a single pulse as shown in FIG. 8 at the output timing designated in the start timing setting data TA1, with the timing of the rising edge of the reset signal RST shown in FIG. 8 as the reference point.

In addition, the control signal generation part 410 generates the delay pulse signal LDL with a single pulse as shown in FIG. 8 at the output timing designated in the start timing setting data A2, with the timing of the rising edge of the reset signal RST shown in FIG. 8 as the reference point.

The control signal generation part 410 supplies the clock signal CLK1 and the delay pulse signal LDR to the rightward delay generation part 411 and supplies the clock signal CLK2 and the delay pulse signal LDL to the leftward delay generation part 412. In addition, the control signal generation part 410 supplies the reset signal RST to the delay selection part 413.

The rightward delay generation part 411 includes a shift register in which flip-flops DF1 to DFk as the first to $k^{th}$ delay circuits respectively corresponding to the first to $k^{th}$ output channels are connected sequentially in the order from 1 to k, as shown in FIG. 7. The flip-flops DF1 to DFk receive the clock signal CLK1 from the respective clock terminals. The flip-flop DF1 receives the delay pulse signal LDR with a single pulse shown in FIG. 8, and outputs the delay pulse signal LDR at the timing of the clock signal CLK1 and supplies the delay pulse signal LDR to the flip-flop DF2 of the next stage. Similarly, each of the flip-flops DF2 to DFk supplies the delay pulse signal LDR output by the flip-flop DF of the previous stage to the flip-flop DF of the next stage at the timing of the clock signal CLK1.

In the rightward delay generation part 411, the output signals respectively output from the flip-flops DF1 to DFk are supplied to the delay selection part 413 as the rightward delay shift signals R1 to Rk.

The leftward delay generation part 412 includes a shift register in which flip-flops DF11 to DF1*k* as the first to $k^{th}$ delay circuits respectively corresponding to the first to $k^{th}$ output channels are connected sequentially in the order from k to 1, as shown in FIG. 7. The flip-flops DF1*k* to DF11 receive the clock signal CLK2 from the respective clock terminals. The flip-flop DF1*k* receives the delay pulse signal LDL with a single pulse shown in FIG. 8, and outputs the delay pulse signal LDL at the timing of the clock signal CLK2 and supplies the delay pulse signal LDL to the flip-flop DF1*k*−1 of the next stage. Similarly, each of the flip-flops DF1*k*−1 to DF11 supplies the delay pulse signal LDR output by the flip-flop DF of the previous stage to the flip-flop DF of the next stage at the timing of the clock signal CLK2.

In the leftward delay generation part 412, the output signals respectively output from the flip-flops DF11 to DF1*k* are supplied to the delay selection part 413 as the leftward delay shift signals L1 to Lk.

The delay selection part 413 has delay selection circuits SE1 to SEk respectively provided in correspondence with the first to $k^{th}$ output channels. The delay selection circuits SE1 to SEk are respectively formed by the same circuit configuration, and respectively receive the reset signal RST. In addition, each of the delay selection circuits SE1 to SEk receives a pair of the rightward delay shift signal R(f) (f being an integer of 1 to k) and the leftward delay shift signal L(f) corresponding to its own output channel. For example, as shown in FIG. 8, the delay selection circuit SE1 receives the rightward delay shift signal R1 and the leftward delay shift signal L1. In addition, the delay selection circuit SE2 receives the rightward delay shift signal R2 and the leftward delay shift signal L2.

As shown in FIG. 8, the delay selection circuits SE1 to SEk set the output timing signals NC1 to NCk that are respectively output to the state of logic level 1 from logic level 0 together at the timing of the rising edge part of the reset signal RST. Then, each of the delay selection circuits SE1 to SEk transitions the output timing signal NC(f) to logic level 0 at the earlier timing at which the delay pulse signal is present between the received rightward delay shift signal R(f) and leftward delay shift signal L(f).

For instance, in the example shown in FIG. 8, between the rightward delay shift signal R1 and the leftward delay shift signal L1, the timing at which the delay pulse signal is present is earlier in the rightward shift signal R1. Accordingly, as shown in FIG. 8, the delay selection circuit SE1 receiving the pair of the rightward delay shift signal R1 and the leftward delay shift signal L1 selects the rightward delay shift signal R1 and transitions the output timing signal NC1 from logic level 1 to the state of logic level 0 at the timing of the rising edge part thereof.

In the case where the circuit configuration shown in FIG. 7 is adopted as the rightward delay generation circuit 411, the leftward delay generation part 412, and the delay selection part 413, the time point of the falling edge part of each of the output timing signals NC1 to NCk shown in FIG. 8 becomes the output timing. Accordingly, the data latch part 42 outputs the latched k pixel data PD at the timings of the respective falling edge parts of the output timing signals NC1 to NCk.

Figure 9:
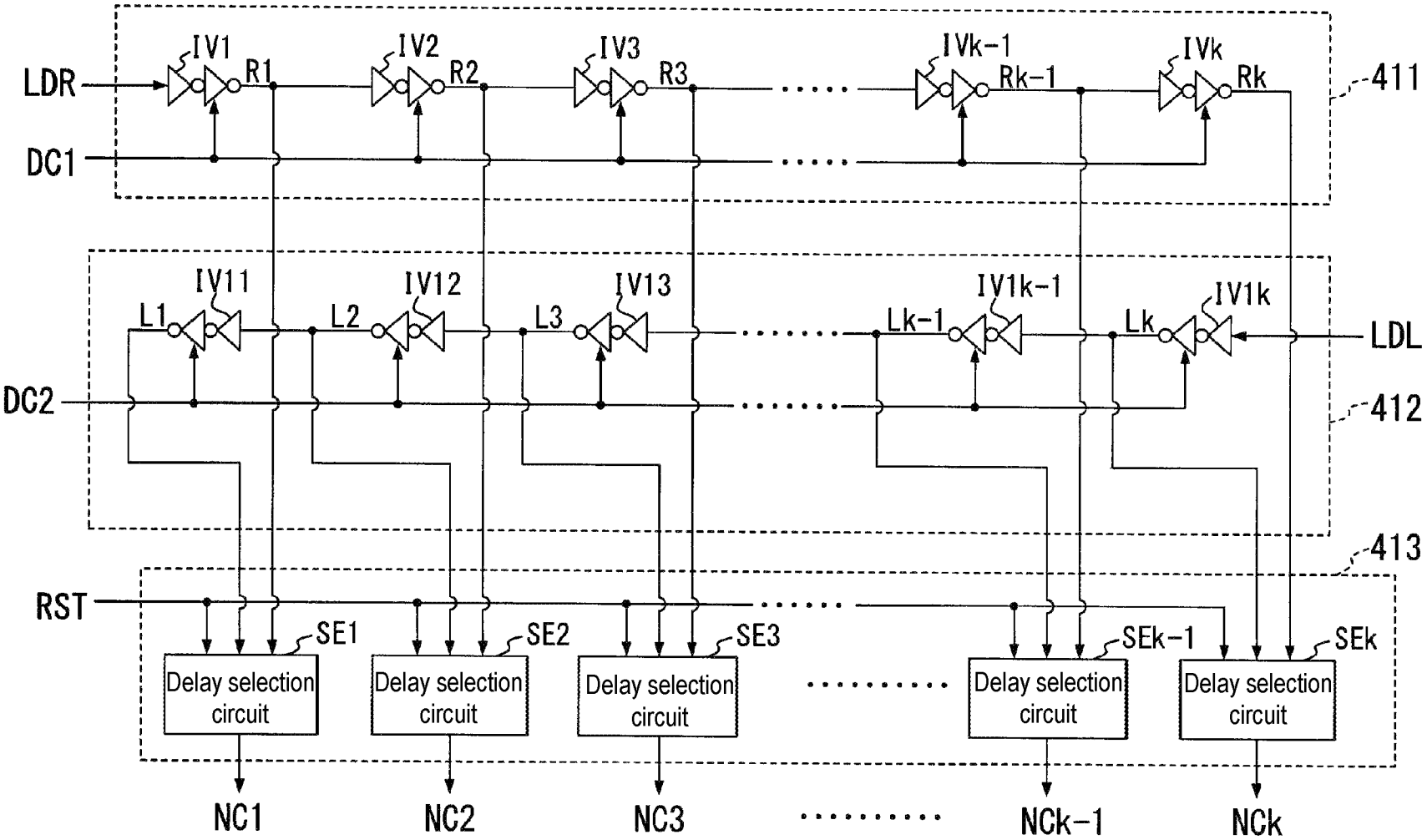
FIG. 9 is a circuit diagram illustrating another example of the internal configurations of the rightward delay generation part 411 and the leftward delay generation part 412.

FIG. 9 is a circuit diagram illustrating another example of the internal configurations of the rightward delay generation part 411 and the leftward delay generation part 412. Since the internal configuration of the delay selection part 413 in FIG. 9 is the same as the one shown in FIG. 7, the descriptions thereof are omitted.

In the configuration shown in FIG. 9, in place of the flip-flops DF1 to DFk shown in FIG. 7 and adopted as the delay circuits of the rightward delay generation part 411, inverter circuits IV1 to IVk each including a pair of inverter elements connected sequentially with each other are adopted. In addition, as the delay circuits of the leftward delay generation part 412, in place of the flip-flops DF1*k* to DF11 shown in FIG. 7, inverter circuits IV1*k* to IV11 each including inverters of two stages connected sequentially are adopted. Also, the inverter circuits IV1 to IVk and IV1*k* to IV11 are each a delay variable element in which the element delay time required from reception of an input signal to production of an output is variable by a delay control signal.

In addition, in place of the clock signal CLK1, the control signal generation part 410 supplies a delay control signal DC1 indicating the unit delay time designated in the delay shift amount setting data SA1 to the inverter circuits IV1 to IVk. Accordingly, each of the inverter circuits IV1 to IVk delays the delay pulse signal LDR supplied from the previous stage by the delay time indicated in the delay control signal DC1 and outputs to the inverter circuit of the next stage.

In addition, in place of the clock signal CLK2, the control signal generation part 410 supplies a delay control signal DC2 indicating the unit delay time designated in the delay shift amount setting data SA2 to the inverter circuits IV1*k* to IV11. Accordingly, each of the inverter circuits IV1*k* to IV11 delays the delay pulse signal LDL supplied from the previous stage by the delay time indicated in the delay control signal DC2 and outputs to the inverter circuit of the next stage.

Figure 10:
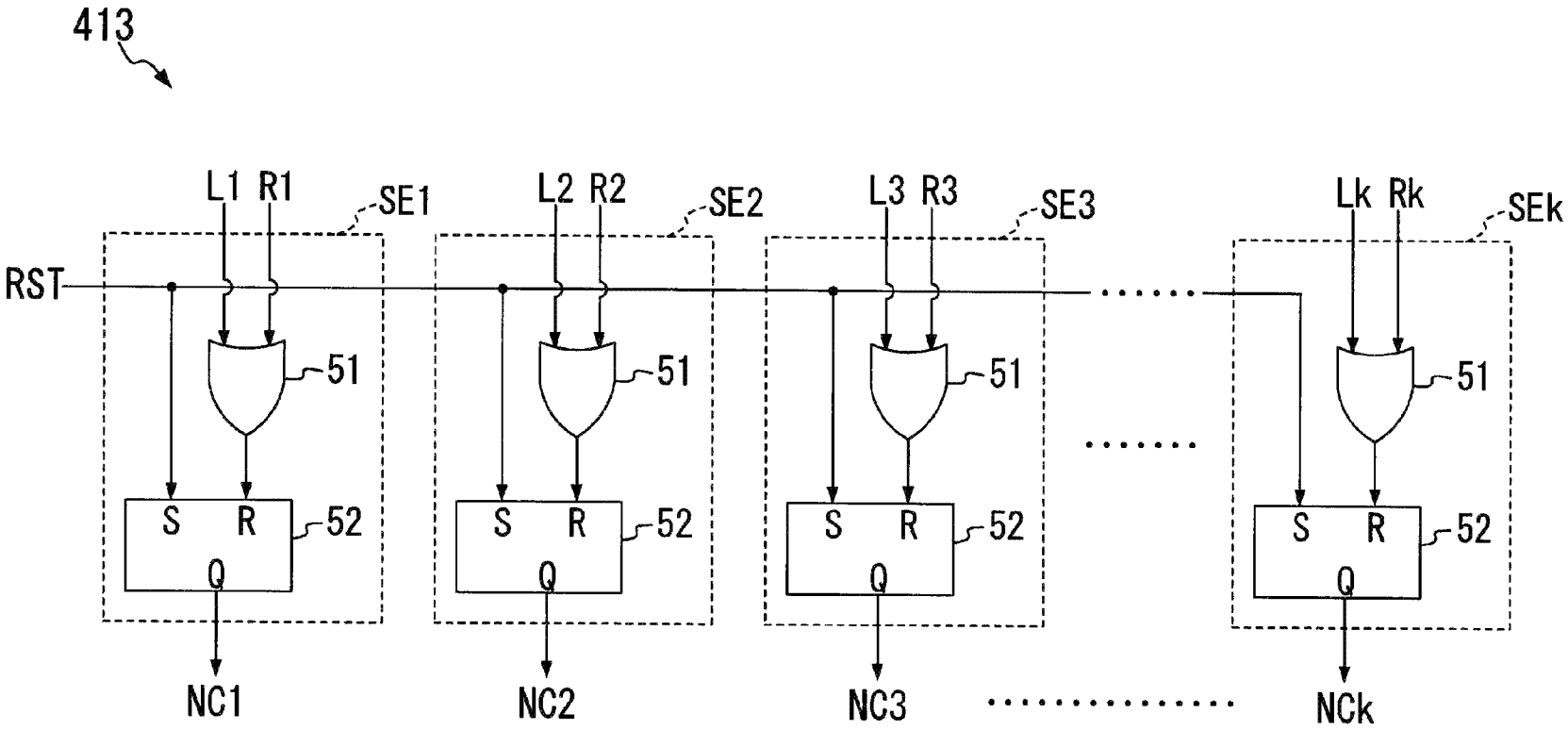
FIG. 10 is a circuit diagram illustrating an example of the internal configuration of the delay selection part 413.

FIG. 10 is a circuit diagram illustrating an example of the internal configurations of the delay selection circuits SE1 to SEk shown in FIG. 7 or 9 and realizing the operation shown in FIG. 8.

As shown in FIG. 10, the respective delay selection circuits SE1 to SEk have the same configuration, that is, each of the delay selection circuits SE1 to SEk includes an OR gate and an RS flip-flop 52.

The OR gate 51 receives the pair of the rightward delay shift signal R(f) (f being an integer of 1 to k) and the leftward delay shift signal L(f) corresponding to the same output channel and supplies the result of the logic sum of the two to the reset terminal of the RS flip-flop 52. In the case where at least one of the rightward delay shift signal R(f) and the leftward delay shift signal L(f) represents logic level 1, the OR gate 51 supplies a signal of logic level 1 prompting a reset to the reset terminal of the RS flip-flop 52.

In addition, the RS flip-flop 52 receives the reset signal RST by using its own set terminal. The RS flip-flop 52 is changed to the set state and outputs a signal of logic level 1 in the case where its own set terminal receives the reset signal RST of logic level 1. Meanwhile, in the case where its own reset terminal receives a signal of logic level 1, the RS flip-flop 52 is changed to the reset state and outputs a signal of logic level 0.

The delay selection circuits SE1 to SEk output the signals output from the respective RS flip-flops 52 as the output timing signals NC1 to NCk to the data latch part 42.

In the example shown in FIG. 10, the logic sum of the OR gate 51, that is, the output of the OR gate is supplied to the reset terminal of the RS flip-flop 52, and the reset signal RST is supplied to the set terminal of the RS flip-flop 52. However, it may also be that the output of the OR gate is supplied to the set terminal, and the reset signal RST is supplied to the reset terminal. At this time, the time points of the rising edge parts of the respective output timing signals NC1 to NCk become the output timings. In brief, the configuration suffices as long as the output of the OR gate is supplied to one of the reset terminal and the set terminal of the RS flip-flop 52, and the reset signal RST is supplied to the other of the reset terminal and the set terminal of the RS flip-flop 52.

Figure 11:
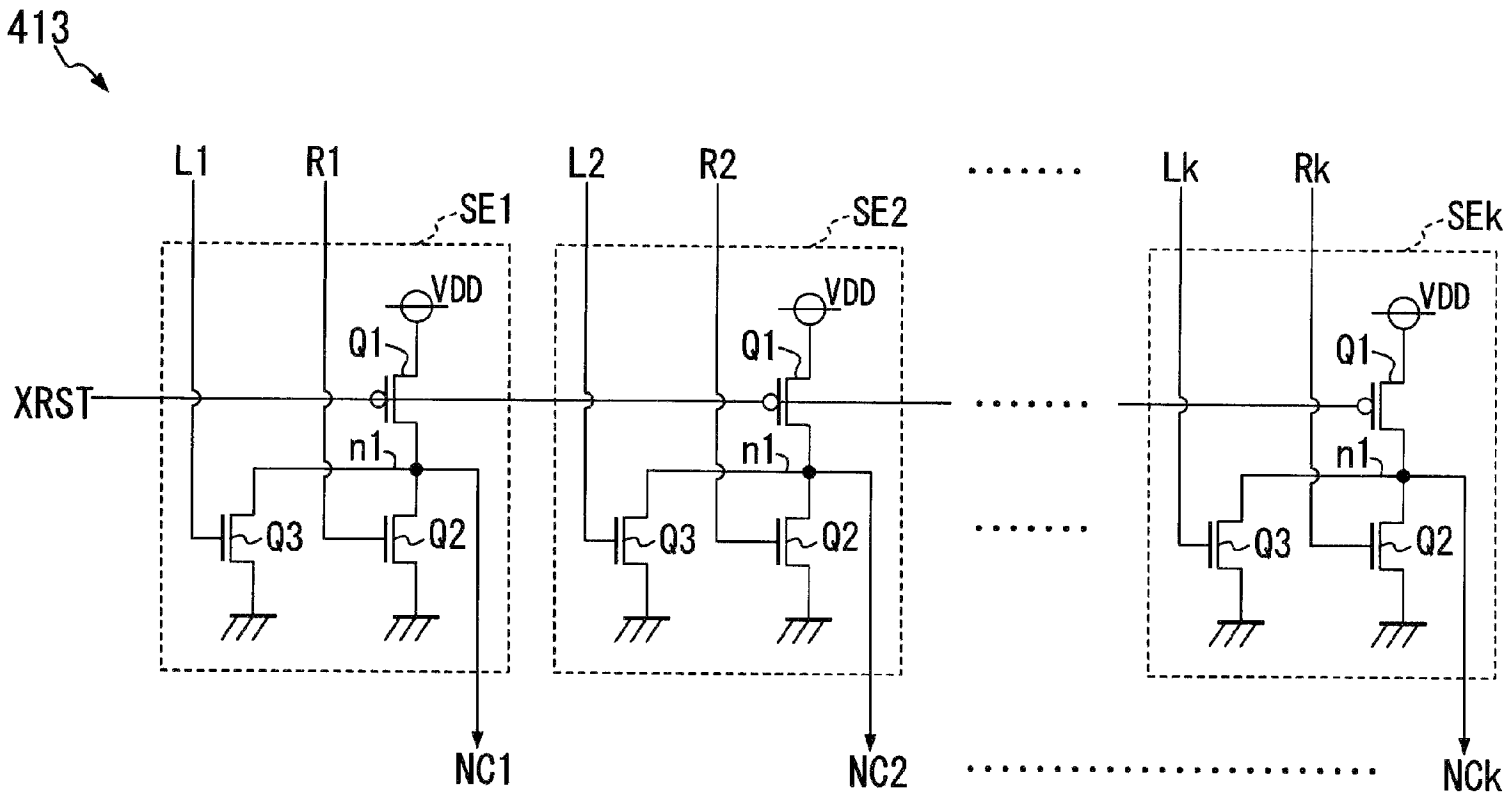
FIG. 11 is a circuit diagram illustrating another example of the internal configuration of the delay selection part 413.

FIG. 11 is a circuit diagram illustrating another example of the internal configurations of the delay selection circuits SE1 to SEk shown in FIG. 7 or 9 and realizing the operation shown in FIG. 8.

When the circuit configuration shown in FIG. 11 is adopted for each of the delay selection circuits SE1 to SEk, the control signal generation part 410 generates an inverting reset signal inverting the logic level of the reset signal RST in place of the reset signal RST shown in FIG. 8.

As shown in FIG. 11, each of the delay selection circuits SE1 to SEk has the same configuration, that is, each of them includes a P-channel metal oxide semiconductor (MOS) type transistor Q1, and N-channel MOS type transistors Q2 and Q3.

The transistor Q1 receives the inverting reset signal XRST shown in FIG. 8 by using its own gate. The transistor Q1 is in the state of being turned on when the inverting reset signal XRST is in the state of logic level 0 and accumulates charges in a node n1 by transmitting the current based on the power supply voltage VDD to the node n1 (precharge). The transistor Q1 raises the voltage of the node n1 by such precharge to reach the state of logic level 1.

The transistor Q2 receives the rightward delay shift signal R(f) in the pair of the rightward delay shift signal R(f) (f being an integer of 1 to k) and the leftward delay shift signal L(f) corresponding to the same output channel by using its own gate. The transistor Q2 is in the state of being turned on when the rightward delay shift signal R(f) is in the state of logic level 1 and discharges the charges accumulated in the node n1 (discharge). Accordingly, the transistor Q2 causes the node n1 to reach the state of logic level 0.

The transistor Q3 receives the leftward delay shift signal L(f) in the pair of the rightward delay shift signal R(f) and the leftward delay shift signal L(f) corresponding to the same output channel by using its own gate. The transistor Q3 is in the state of being turned on when the leftward delay shift signal L(f) is in the state of logic level 1 and discharges the charges accumulated in the node n1 (discharge). Accordingly, the transistor Q3 causes the node n1 to reach the state of logic level 0.

The delay selection circuits SE1 to SEk output the voltages of the respective nodes n1 as the output timing signals NC1 to NCk to the data latch part 42.

In the configuration shown in FIG. 11, when the inverting reset signal XRST shown in FIG. 8 is changed to logic level 0, the nodes n1 of the respective delay selection circuits SE1 to SEk are precharged by the transistors Q1 to set the nodes n1 to the state of logic level 1. Accordingly, regarding the output timing signals NC1 to NCk corresponding to the states of the respective nodes n1, as shown in FIG. 8, the output timing signals NC1 to NCk are set to the state of logic level 1 together. Then, by using the one being firstly changed to the state of logic level 1 between the rightward delay shift signal R(f) and the leftward delay shift signal L(f), the transistor Q2 or the transistor Q3 discharges the charges accumulated in the node n1. Accordingly, the output timing signal NC transitions from logic level 1 to the state of logic level 0.

For example, as shown in FIG. 8, between the rightward delay shift signal R1 and the leftward delay shift signal L1 corresponding to the first output channel, the rightward delay shift signal R1 firstly transitions to logic level 1. Accordingly, as shown in FIG. 8, at the timing of the rising edge part of the rightward delay shift signal R1, by discharging the node n1 by using the transistor Q2 of the delay selection circuit SE1, as shown in FIG. 8, the output timing signal NC1 as the output of the delay selection circuit SE1 transitions to logic level 0.

Figure 12:
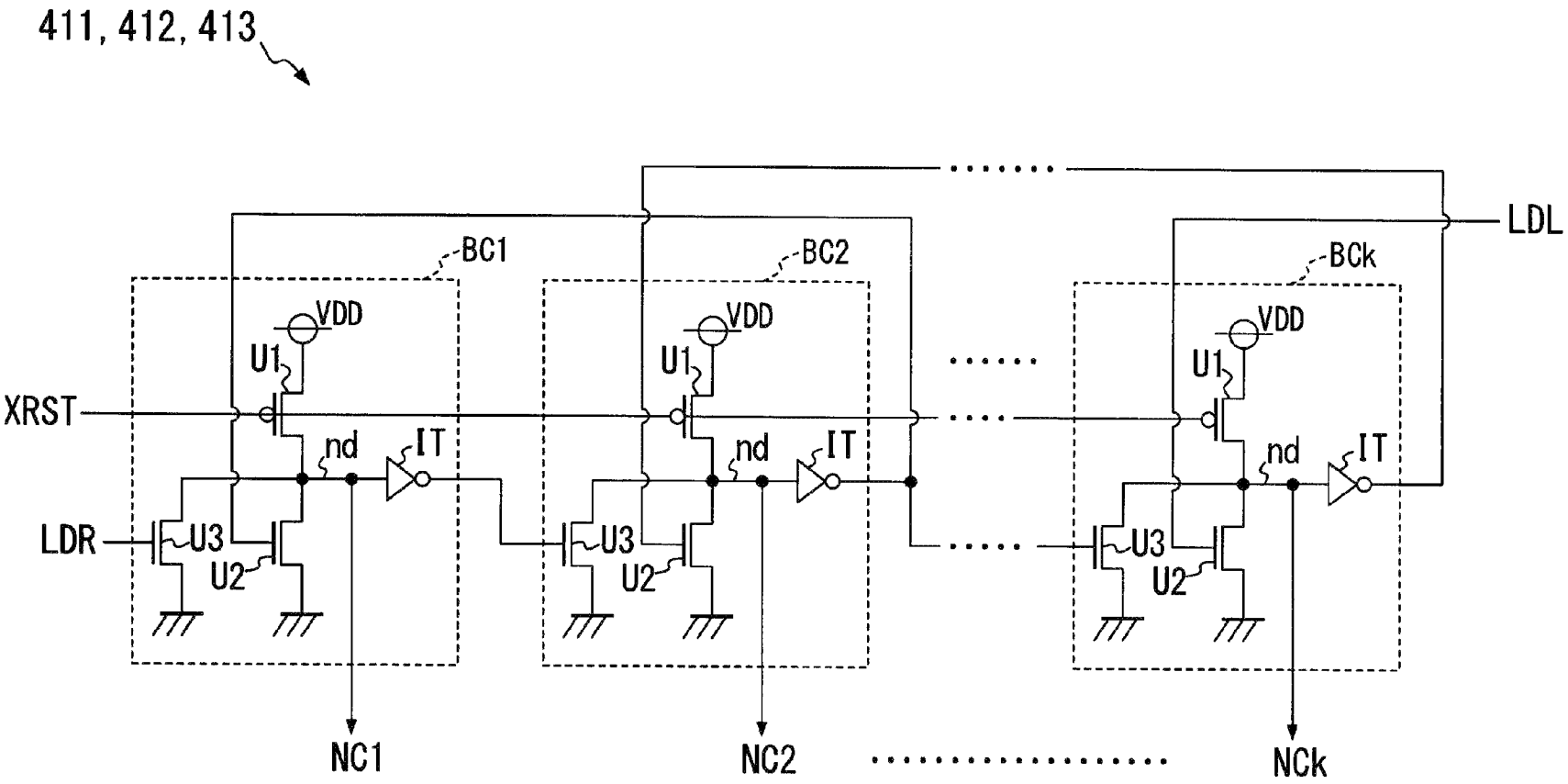
FIG. 12 is a circuit diagram illustrating a circuit realized by a configuration in which the functions of the rightward delay generation part 411, the leftward delay generation part 412, and the delay selection part 413 are simplified.

FIG. 12 is a circuit diagram illustrating a circuit realized by a configuration in which the functions performed by the rightward delay generation part 411, the leftward delay generation part 412, and the delay selection part 413 are simplified.

The circuit shown in FIG. 12 is provided with circuit blocks BC1 to BCk including the same circuit configuration and respectively corresponding to the first to $k^{th}$ output channels.

Each of the circuit blocks BC1 to BCk includes an inverter IT, a P-channel MOS type transistor U1, and N-channel MOS type transistors U2 and U3.

The transistor U1 of each of the circuit blocks BC1 to BCk receives the inverting reset signal XRST shown in FIG. 8 by using its own gate. The transistor U1 is in the state of being turned on when the inverting reset signal XRST is in the state of logic level 0 and accumulates charges in a node nd by transmitting the current based on the power supply voltage VDD to the node nd (precharge) The transistor U1 raises the voltage of the node nd by such precharge to reach the state of logic level 1.

Among the circuit blocks BC1 to BCk, the transistor U2 of each of the circuit blocks BC, except for the circuit block BCk corresponding the $k^{th}$ output channel, receives the inverting output timing signal output from the circuit block BC corresponding to the output channel of the next stage by using its own gate. The transistor U2 is in the state of being turned on when the inverting output timing signal is in the state of logic level 1 and discharges the charges accumulated in the node nd (discharge). Accordingly, the transistor U2 causes the node nd to reach the state of logic level 0.

The transistor U2 of the circuit block BCk corresponding to the $k^{th}$ output channel receives the delay pulse signal LDL based on the start timing setting data TA2 by using its own gate. The transistor U2 of the circuit block BCk is in the state of being turned on when the delay pulse signal LDL is in the state of logic level 1 and discharges the charges accumulated in the node nd (discharge). Accordingly, the transistor U2 causes the node nd to reach the state of logic level 0.

Among the circuit blocks BC1 to BCk, a transistor U3 of the circuit block BC1 corresponding to the first output channel receives the delay pulse signal LDR based on the start timing setting data TA1 by using its own gate. The transistor U3 of the circuit block BC1 is in the state of being turned on when the delay pulse signal LDR is in the state of logic level 1 and discharges the charges accumulated in the node nd (discharge). Accordingly, the transistor U3 of the circuit block BC1 causes the node nd to reach the state of logic level 0.

The inverter IT of the circuit block BC1 supplies the signal inverting the logic level of the node nd, as the inverting output timing signal, to the gate of the transistor U3 of the circuit block BC1 of the next stage.

Among the circuit blocks BC1 to BCk, the inverter IT of each of the circuit blocks BC2 to BCk−1 supplies the signal inverting the logic level of the node nd, as the inverting output timing signal, to the gates of the transistor U3 of each of the circuit blocks BC of the next stage and the transistor U2 of each of the circuit blocks BC of the previous stage.

The inverter IT of the circuit block BCk supplies the signal inverting the logic level of the node nd, as the inverting output timing signal, to the gate of the transistor U2 of the circuit block BCk−1 of the previous stage.

The transistor U3 of each of the circuit blocks BC2 to BCk receives the inverting output timing signal output from the circuit block BC of the previous stage, and is in the state of being turned on when the inverting output timing signal is in the state of logic level 1 and discharges the charges accumulated in the node nd (discharge). Accordingly, the transistor U3 of each of the circuit blocks BC2 to BCk causes the node nd to reach the state of logic level 0.

The circuit blocks BC1 to BCk output the voltages of the respective nodes nd as the output timing signals NC1 to NCk to the data latch part 42.

In the configuration shown in FIG. 12, as shown in FIG. 8, firstly, the transistor U1 of each of the circuit blocks BC1 to BCk precharges the node nd in accordance with the inverting reset signal XRST of logic level 0. Accordingly, as shown in FIG. 8, the output timing signals NC1 to NCk are changed to the state of logic level 1 together.

Then, when the delay pulse signal LDR shown in FIG. 8 is supplied to the gate of the transistor U3 of the circuit block BC1, the node nd of the circuit block BC1 is discharged, and the output timing signal NC1 transitions to logic level 0, as shown in FIG. 8. Accordingly, the inverter IT of the circuit block BC1 supplies the inverting output timing signal of logic level 1 to the gate of the transistor U3 of the circuit block BC2 of the next stage. Then, the node nd of the circuit block BC2 is discharged by the transistor U3 of the circuit block BC2, and the output timing signal NC2 as shown in FIG. 8 transitions to logic level 0.

In addition, in this period, when the delay pulse signal LDL shown in FIG. 8 is supplied to the gate of the transistor U2 of the circuit block BCk, the node nd of the circuit block BCk is discharged, and the output timing signal NCk transitions to logic level 0, as shown in FIG. 8. Accordingly, the inverter IT of the circuit block BCk supplies the inverting output timing signal of logic level 1 to the gate of the transistor U2 of the circuit block BCk−1 of the previous stage. Then, the node nd of the circuit block BCk−1 is discharged by the transistor U2 of the circuit block BCk−1, and the output timing signal NCk−1 transitions to logic level 0, as shown in FIG. 8.

Accordingly, in the case where the configuration shown in FIG. 12 is adopted as the rightward delay generation part 411, the leftward delay generation part 412, and the delay selection part 413, the operations shown in FIGS. 3 to 6 and 8 can be realized.

It should be noted that, in the example shown in FIG. 2, by outputting the k pixel data PD latched by the data latch part 42 at the output timings of the output timing signals NC1 to NCk, the output timing of each of the respective output channels of the pixel driving voltages G1 to Gk is adjusted. However, it may also be that the pixel driving voltages G1 to Gk are output at the output timings of the output timing signals NC1 to NCk.

In brief, as the display driver (e.g., 4*a* to *e*4) of the disclosure, it suffices as long as the output timing control part and the output part as follows are provided.

An output timing control part (41) generates first to $k^{th}$ output timing signals (NC1 to NCk) indicating respective output timings of first to $k^{th}$ channels. An output part (42, 43) respectively outputs first to $k^{th}$ pixel driving voltages (G1 to Gk) at the output timings respectively indicated by the first to $k^{th}$ output timing signals.

The output timing control part (41) includes a control signal generation part, first and second delay generation parts, and a delay selection part as follows.

The control signal generation part receives a designation (TA1, TA2) of the output timing at each of the first to $k^{th}$ output channels, and generates a first delay pulse signal (LDR) at the output timing of the first output channel that is designated. In addition, at the output timing of the $k^{th}$ output channel that is designated, a second delay pulse signal (LDL) is generated.

The first delay generation part (411) receives the first delay pulse signal, and generates first to $k^{th}$ first direction delay shift signals (R1 to Rk) in which a first delay pulse signal is present after a delay increased by a unit delay time for each output channel from the first output channel to the $k^{th}$ output channel.

The second delay generation part (412) receives the second delay pulse signal, and generates first to $k^{th}$ second direction delay shift signals (L1 to Lk) in which a second delay pulse signal is present after a delay increased by the unit delay time for each output channel from the $k^{th}$ output channel to the first output channel.

The delay selection part (413), for each of the first to $k^{th}$ output channels, selects one whose timing at which a delay pulse signal is present is earlier from each of the first to $k^{th}$ first direction delay shift signals and each of the first to $k^{th}$ second direction delay shift signals that are those corresponding to the same output channel, and, for the respective first to $k^{th}$ output channels, outputs the selected signals as first to $k^{th}$ output timing signals (NC1 to NCk).

What is claimed is:

1. A display driver, having first to $k^{th}$ output channels outputting first to $k^{th}$ pixel driving voltages respectively corresponding luminance levels of respective pixels indicated in a video signal, k being an integer of 2 or more, the display driver comprising:

an output timing control part, generating first to $k^{th}$ output timing signals indicating output timings at the respective first to $k^{th}$ output channels; and an output part, respectively outputting the first to $k^{th}$ pixel driving voltages at the output timings indicated in the respective first to $k^{th}$ output timing signals, wherein the output timing control part comprises:

a control signal generation part, receiving a designation of the output timing at each of the first to $k^{th}$ output channels and generating a first delay pulse signal at the output timing of the first output channel that is designated and generating a second delay pulse signal at the output timing of the $k^{th}$ output channel that is designated;

a first delay generation part, receiving the first delay pulse signal, and generating first to $k^{th}$ first direction delay shift signals in which the first delay pulse signal is present after a delay increased by a unit delay time for each output channel from the first output channel to the $k^{th}$ output channel, a second delay generation part, receiving the second delay pulse signal, and generating first to $k^{th}$ second direction delay shift signals in which the second delay pulse signal is present after the delay increased by the unit delay time for each output channel from the $k^{th}$ output channel to the first output channel, and a delay selection part, for each of the first to $k^{th}$ output channels, selecting one signal whose timing at which the delay pulse signal is present is earlier from each of the first to $k^{th}$ first direction delay shift signals and each of the first to $k^{th}$ second direction delay shift signals that are signals corresponding to the same output channel, and outputting the selected signals for the respective first to $k^{th}$ output channels as the first to $k^{th}$ output timing signals.

2. The display driver as claimed in claim 1, wherein the first delay generation part comprises a first delay circuit group in which first to $k^{th}$ delay circuits respectively corresponding to the first to $k^{th}$ output channels are connected sequentially in an order from 1 to k and is configured to input the first delay pulse signal to the first delay circuit of the first delay circuit group and set respective outputs of the first to $k^{th}$ delay circuits of the first delay circuit group as the first to $k^{th}$ first delay shift signals, and the second delay generation part comprises a second delay circuit group in which first to $k^{th}$ delay circuits respectively corresponding to the first to $k^{th}$ output channels are connected sequentially in an order from k to 1 and is configured to input the second delay pulse signal to the $k^{th}$ delay circuit of the second delay circuit group and set respective outputs of the first to $k^{th}$ delay circuits of the second delay circuit group as the first to $k^{th}$ second delay shift signals.

3. The display driver as claimed in claim 2, wherein the delay circuits comprised in each of the first delay circuit group and the second delay circuit group are flip-flops, the first delay circuit group comprises a first shift register configured so that first to $k^{th}$ flip-flops corresponding to the first to $k^{th}$ output channels are connected sequentially in an order from the first to $k^{th}$ flip-flops and the first delay pulse signal is input to the first flip-flop, and the second delay circuit group comprises a second shift register configured so that first to $k^{th}$ flip-flops corresponding to the first to $k^{th}$ output channels are connected sequentially in an order from the $k_{th}$ to first flip-flops and the second delay pulse signal is input to the $k^{th}$ flip-flop.

4. The display driver as claimed in claim 2, wherein the delay circuits comprised in each of the first delay circuit group and the second delay circuit group are each an inverter circuit comprising a pair of inverter elements connected sequentially with each other, the first delay circuit group is configured so that first to $k^{th}$ inverter circuits corresponding to the first to $k^{th}$ output channels are connected sequentially in the order from 1 to k, and the first delay pulse signal is input to the first inverter circuit, and the second delay circuit group is configured so that first to $k^{th}$ inverter circuits corresponding to the first to $k^{th}$ output channels are connected sequentially in the order from k to 1, and the second delay pulse signal is input to the $k^{th}$ inverter circuit.

5. The display driver as claimed in claim 2, wherein the control signal generation part generates a reset signal in accordance with a horizontal synchronization signal in the video signal, the delay selection part comprises first to $k^{th}$ delay selection circuits respectively corresponding to the first to $k^{th}$ output channels, and each of the first to $k^{th}$ delay selection circuits comprises:

an OR gate, receiving an output of the delay circuit of the first delay circuit group and an output of the delay circuit of the second delay circuit group corresponding to the same output channel among the first to $k^{th}$ delay circuits comprised in the first delay circuit group and the first to $k^{th}$ delay circuits comprised in the second delay circuit group; and an RS flip-flop, receiving one of the reset signal and an output of the OR gate by using a set terminal and receiving another of the reset signal and the output of the OR gate by using a reset terminal, wherein signals respectively output from the RS flip-flops of the respective first to $k^{th}$ delay selection circuits output signals are output as the first to $k^{th}$ output timing signals.

6. The display driver as claimed in claim 3, wherein the control signal generation part generates a reset signal in accordance with a horizontal synchronization signal in the video signal, the delay selection part comprises first to $k^{th}$ delay selection circuits respectively corresponding to the first to $k^{th}$ output channels, and each of the first to $k^{th}$ delay selection circuits comprises:

an OR gate, receiving an output of the delay circuit of the first delay circuit group and an output of the delay circuit of the second delay circuit group corresponding to the same output channel among the first to $k^{th}$ delay circuits comprised in the first delay circuit group and the first to $k^{th}$ delay circuits comprised in the second delay circuit group; and an RS flip-flop, receiving one of the reset signal and an output of the OR gate by using a set terminal and receiving another of the reset signal and the output of the OR gate by using a reset terminal, wherein signals respectively output from the RS flip-flops of the respective first to $k^{th}$ delay selection circuits output signals are output as the first to $k^{th}$ output timing signals.

7. The display driver as claimed in claim 4, wherein the control signal generation part generates a reset signal in accordance with a horizontal synchronization signal in the video signal, the delay selection part comprises first to $k^{th}$ delay selection circuits respectively corresponding to the first to $k^{th}$ output channels, and each of the first to $k^{th}$ delay selection circuits comprises:

an OR gate, receiving an output of the delay circuit of the first delay circuit group and an output of the delay circuit of the second delay circuit group corresponding to the same output channel among the first to $k^{th}$ delay circuits comprised in the first delay circuit group and the first to $k^{th}$ delay circuits comprised in the second delay circuit group; and an RS flip-flop, receiving one of the reset signal and an output of the OR gate by using a set terminal and receiving another of the reset signal and the output of the OR gate by using a reset terminal, wherein signals respectively output from the RS flip-flops of the respective first to $k^{th}$ delay selection circuits output signals are output as the first to $k^{th}$ output timing signals.

8. The display driver as claimed in claim 2, wherein the control signal generation part generates a reset signal in accordance with a horizontal synchronization signal in the video signal, the delay selection part comprises first to $k^{th}$ delay selection circuits respectively corresponding to the first to $k^{th}$ output channels, and each of the first to $k^{th}$ delay selection circuits comprises:

a first node;

a first transistor, precharging the first node in accordance with the reset signal;

a second transistor, discharging the first node in accordance with an output of one of a pair of delay circuits corresponding to the same output channel among the first to $k^{th}$ delay circuits comprised in the first delay circuit group and the first to $k^{th}$ delay circuits comprised in the second delay circuit group; and a third transistor, discharging the first node in accordance with an output of an other of the pair of delay circuits, wherein signals respectively generated in the first nodes of the respective first to $k^{th}$ delay selection circuits are output as the first to $k^{th}$ output timing signals.

9. The display driver as claimed in claim 3, wherein the control signal generation part generates a reset signal in accordance with a horizontal synchronization signal in the video signal, the delay selection part comprises first to $k^{th}$ delay selection circuits respectively corresponding to the first to $k^{th}$ output channels, and each of the first to $k^{th}$ delay selection circuits comprises:

a first node;

a first transistor, precharging the first node in accordance with the reset signal;

a second transistor, discharging the first node in accordance with an output of one of a pair of delay circuits corresponding to the same output channel among the first to $k^{th}$ delay circuits comprised in the first delay circuit group and the first to $k^{th}$ delay circuits comprised in the second delay circuit group; and a third transistor, discharging the first node in accordance with an output of an other of the pair of delay circuits, wherein signals respectively generated in the first nodes of the respective first to $k^{th}$ delay selection circuits are output as the first to $k^{th}$ output timing signals.

10. The display driver as claimed in claim 4, wherein the control signal generation part generates a reset signal in accordance with a horizontal synchronization signal in the video signal, the delay selection part comprises first to $k^{th}$ delay selection circuits respectively corresponding to the first to $k^{th}$ output channels, and each of the first to $k^{th}$ delay selection circuits comprises:

a first node;

a first transistor, precharging the first node in accordance with the reset signal;

a second transistor, discharging the first node in accordance with an output of one of a pair of delay circuits corresponding to the same output channel among the first to $k^{th}$ delay circuits comprised in the first delay circuit group and the first to $k^{th}$ delay circuits comprised in the second delay circuit group; and a third transistor, discharging the first node in accordance with an output of an other of the pair of delay circuits, wherein signals respectively generated in the first nodes of the respective first to $k^{th}$ delay selection circuits are output as the first to $k^{th}$ output timing signals.

11. The display driver as claimed in claim 1, wherein the control signal generation part generates a reset signal in accordance with a horizontal synchronization signal in the video signal, the output timing control part, the first and second delay generation parts, and the delay selection part comprise a configuration in which first to $k^{th}$ circuit blocks respectively corresponding to the first to $k^{th}$ output channels are connected sequentially, and each of the first to $k^{th}$ circuit blocks comprises:

a first node;

a P-channel type first transistor, precharging the first node in accordance with the reset signal;

N-channel type second and third transistors, discharging the first node; and an inverter, inverting a signal of the first node, wherein the second transistor comprised in each of the first to $k-1^{th}$ circuit blocks discharges the first node in accordance with an output of the inverter comprised in the circuit block of a next stage, the third transistor comprised in each of the second to $k^{th}$ circuit blocks discharges the first node in accordance with an output of the inverter comprised in the circuit block of a previous stage, the third transistor comprised in the first circuit block discharges the first node in accordance with the first delay pulse signal, the second transistor comprised in the $k^{th}$ circuit block discharges the first node in accordance with the second delay pulse signal, and signals respectively generated in the first nodes respectively comprised in the second to $k^{th}$ circuit blocks are output as the first to $k^{th}$ output timing signals.

12. The display driver as claimed in claim 3, wherein the control signal generation part receives designations of a first unit delay time and a second unit delay time and generates a first clock signal of a cycle corresponding to the first unit delay time to be supplied to clock terminals of the first to $k^{th}$ flip-flops of the first delay circuit group, and generates a second clock signal of a cycle corresponding to the second unit delay time to be supplied to clock terminals of the first to $k^{th}$ flip-flops of the second delay circuit group.

13. The display driver as claimed in claim 4, wherein the first to $k^{th}$ inverter circuits of each of the first and second delay circuit groups are able to change output delay times based on a delay control signal, the control signal generation part receives designations of a first unit delay time and a second unit delay time, supplies a first delay control signal indicating the first unit delay time that is designated to each of the first to $k^{th}$ inverter circuits of the first delay circuit group, and supplies a second delay control signal indicating the second unit delay time that is designated to each of the first to $k^{th}$ inverter circuits of the second delay circuit group.

* * * * *